US006754630B2

(12) United States Patent
Das et al.

(10) Patent No.: US 6,754,630 B2
(45) **Date of Patent: *Jun. 22, 2004**

(54) SYNTHESIS OF SPEECH FROM PITCH PROTOTYPE WAVEFORMS BY TIME-SYNCHRONOUS WAVEFORM INTERPOLATION

(75) Inventors: Amitava Das, San Diego, CA (US); Eddie L. T. Choy, San Diego, CA (US)

(73) Assignee: Qualcomm, Inc., San Diego, CA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/191,631

(22) Filed: Nov. 13, 1998

(65) Prior Publication Data

US 2001/0051873 A1 Dec. 13, 2001

(51) Int. Cl.[7] ..... G10L 13/04; G10L 13/02

(52) U.S. Cl. ..... 704/268; 704/258; 704/264

(58) Field of Search ..... 704/265, 258, 704/205–207, 221–223, 220, 264

(56) References Cited

U.S. PATENT DOCUMENTS

| | | | | |
|---|---|---|---|---|
| 4,214,125 A | * | 7/1980 | Mozer et al. | 704/207 |
| 5,414,796 A | | 5/1995 | Jacobs et al. | 395/2.3 |
| 5,517,595 A | | 5/1996 | Kleijn | 395/2.14 |
| 5,884,253 A | * | 3/1999 | Kleijn | 704/265 |
| 5,903,866 A | * | 5/1999 | Shoham | 704/265 |
| 6,233,550 B1 | * | 5/2001 | Gersho et al. | 704/220 |
| 6,456,964 B2 | * | 9/2002 | Manjunath et al. | 704/205 |

FOREIGN PATENT DOCUMENTS

| | | | | |
|---|---|---|---|---|
| EP | 0865028 | | 9/1998 | |
| JP | 64-025197 | * | 5/1988 | G10L/3/00 |

OTHER PUBLICATIONS

Crouse, M. & Ramchandran, K., "Joint Thresholding and Quantizer Selection for Decoder–Compatible Baseline JPEG," International Conference on Acoustics, Speech, and Signal Processing, May 1995.*

(List continued on next page.)

*Primary Examiner*—Richemond Dorvil
*Assistant Examiner*—Daniel A. Nolan
(74) *Attorney, Agent, or Firm*—Phil Wadsworth; Charles Brown; Kyong Macek

(57) ABSTRACT

In a method of synthesizing voiced speech from pitch prototype waveforms by time-synchronous waveform interpolation (TSWI), one or more pitch prototypes is extracted from a speech signal or a residue signal. The extraction process is performed in such a way that the prototype has minimum energy at the boundary. Each prototype is circularly shifted so as to be time-synchronous with the original signal. A linear phase shift is applied to each extracted prototype relative to the previously extracted prototype so as to maximize the cross-correlation between successive extracted prototypes. A two-dimensional prototype-evolving surface is constructed by unsampling the prototypes to every sample point. The two-dimensional prototype-evolving surface is re-sampled to generate a one-dimensional, synthesized signal frame with sample points defined by piecewise continuous cubic phase contour functions computed from the pitch lags and the phase shifts added to the extracted prototypes. A pre-selection filter may be applied to determine whether to abandon the TSWI technique in favor of another algorithm for the current frame. A post-selection performance measure may be obtained and compared with a predetermined threshold to determine whether the TSWI algorithm is performing adequately.

64 Claims, 7 Drawing Sheets

OTHER PUBLICATIONS

Yang, H., Kleijn, W., Deprettere, E., Chen, Y., "Pitch Synchronous Modulated Lapped Transform of the Linear Prediction of Residual Speech," International Conference on Signal Processing, Oct. 1998.*

Quatieri et al ("Peak–to–RMS Reduction of Speech Based on a Sinusoidal Model", IEEE Transactions on Signal Processing, Feb. 1991).*

Hao et al ("2 Kbps–2.4 Kbps Low Complexity Interpolative Vocoder". ICCT International Conference on Communication Technology Proceedings, Oct. 1998).*

Burnett et al ("A Mixed Prototype Waveform/CELP Coder for Sub–3 Kbit/S", IEEE International Conference on Acoustics, Speech, and Signal Processing, Apr. 1993).*

Das, et al. "Multimode Variable Bit Rate Speech Coding: An Efficient Paradigm for High–Quality Low–Rate Representation of Speech Signal" IEEE 4: 2307–2310 (1999).

Kleijn, et al. "A Speech Coder Based on Decomposition of Characteristic Waveforms" IEEE pp. 508–511 (1995).

Kleijn, et al. "A Low–Complexity Waveform Interpolation Coder" IEEE vol Conf 21: 212–215 (1996).

Li, et al. "Non–Linear Interpolation in Prototype Waveform Interpolation" IEE Colloqium on Speech Coding: Techniques & Applications, GB 1:1–5 (1994).

1978 Digital Processing of Speech Signals, "Linear Predictive Coding of Speech", Rabiner et al., pp. 396–453.

1986 IEEE Transactions on Acoustics, Speech, and Signal Processing, vol. ASSP–34, No. 4, "Speech Analysis/Synthesis Based on a Sinusoidal Representation", McAulay et al., pp. 744–754.

1995 Speech Coding and Synthesis, "Linear–Prediction based Analysis–by–Synthesis Coding", Kroon et al., pp. 79–119; "Sinusoidal Coding", McAulay et al., pp. 121–173; "Waveform Interpolation for Coding and Synthesis", Kleijn et al., pp. 175–207, "Multimode and Variable–Rate Coding of Speech", Das et al., pp. 257–288.

* cited by examiner

SYNTHESIS OF SPEECH FROM PITCH PROTOTYPE WAVEFORMS BY TIME-SYNCHRONOUS WAVEFORM INTERPOLATION

BACKGROUND OF THE INVENTION

I. Field of the Invention

The present invention pertains generally to the field of speech processing, and more specifically to a method and apparatus for synthesis of speech from pitch prototype waveforms by time-synchronous waveform interpolation (TSWI).

II. Background

Transmission of voice by digital techniques has become widespread, particularly in long distance and digital radio telephone applications. This, in turn, has created interest in determining the least amount of information that can be sent over a channel while maintaining the perceived quality of the reconstructed speech. If speech is transmitted by simply sampling and digitizing, a data rate on the order of sixty-four kilobits per second (kbps) is required to achieve a speech quality of conventional analog telephone. However, through the use of speech analysis, followed by the appropriate coding, transmission, and resynthesis at the receiver, a significant reduction in the data rate can be achieved.

Devices that employ techniques to compress speech by extracting parameters that relate to a model of human speech generation are called speech coders. A speech coder divides the incoming speech signal into blocks of time, or analysis frames. Speech coders typically comprise an encoder and a decoder, or a codec. The encoder analyzes the incoming speech frame to extract certain relevant parameters, and then quantizes the parameters into binary representation, i.e., to a set of bits or a binary data packet. The data packets are transmitted over the communication channel to a receiver and a decoder. The decoder processes the data packets, unquantizes them to produce the parameters, and then resynthesizes the speech frames using the unquantized parameters.

The function of the speech coder is to compress the digitized speech signal into a low-bit-rate signal by removing all of the natural redundancies inherent in speech. The digital compression is achieved by representing the input speech frame with a set of parameters and employing quantization to represent the parameters with a set of bits. If the input speech frame has a number of bits $N_i$ and the data packet produced by the speech coder has a number of bits $N_o$, the compression factor achieved by the speech coder is $C_r=N_i/N_o$. The challenge is to retain high voice quality of the decoded speech while achieving the target compression factor. The performance of a speech coder depends on (1) how well the speech model, or the combination of the analysis and synthesis process described above, performs, and (2) how well the parameter quantization process is performed at the target bit rate of $N_0$ bits per frame. The goal of the speech model is thus to capture the essence of the speech signal, or the target voice quality, with a small set of parameters for each frame.

A speech coder is called a time-domain coder if its model is a time-domain model. A well-known example is the Code Excited Linear Predictive (CELP) coder described in L. B. Rabiner & R. W. Schafer, *Digital Processing of Speech Signals* 396–453 (1978), which is fully incorporated herein by reference. In a CELP coder, the short term correlations, or redundancies, in the speech signal are removed by a linear prediction (LP) analysis, which finds the coefficients of a short-term formant filter. Applying the short-term prediction filter to the incoming speech frame generates an LP residue signal, which is further modeled and quantized with long-term prediction filter parameters and a subsequent stochastic codebook. Thus, CELP coding divides the task of encoding the time-domain speech waveform into the separate tasks of encoding of the LP short-term filter coefficients and encoding the LP residue. The goal is to produce a synthesized output speech waveform that closely resembles the input speech waveform. To accurately preserve the time-domain waveform, the CELP coder further divides the residue frame into smaller blocks, or sub-frames, and continue the analysis-by-synthesis method for each sub-frame. This requires a high number of bits $N_o$ per frame because there are many parameters to quantize for each sub-frame. CELP coders typically deliver excellent quality when the available number of bits $N_o$ per frame is large enough for coding bits rates of 8 kbps and above.

Waveform interpolation (WI) is an emerging speech coding technique in which for each frame of speech a number M of prototype waveforms is extracted and encoded with the available bits. Output speech is synthesized from the decoded prototype waveforms by any conventional waveform-interpolation technique. Various WI techniques are described in W. Bastiaan Kleijn & Jesper Haagen, *Speech Coding and Synthesis* 176–205 (1995), which is fully incorporated herein by reference. Conventional WI techniques are also described in U.S. Pat. No. 5,517,595, which is fully incorporated by reference herein. In such conventional WI techniques, however, it is necessary to extract more than one prototype waveform per frame in order to deliver accurate results. Additionally, no mechanism exists to provide time synchrony of the reconstructed waveform. For this reason the synthesized output WI waveform is not guaranteed to be aligned with the original input waveform.

There is presently a surge of research interest and strong commercial needs to develop a high-quality speech coder operating at medium to low bit rates (i.e., in the range of 2.4 to 4 kbps and below). The application areas include wireless telephony, satellite communications, Internet telephony, various multimedia and voice-streaming applications, voice mail, and other voice storage systems. The driving forces are the need for high capacity and the demand for robust performance under packet loss situations. Various recent speech coding standardization efforts are another direct driving force propelling research and development of low-rate speech coding algorithms. A low-rate speech coder creates more channels, or users, per allowable application bandwidth, and a low-rate speech coder coupled with an additional layer of suitable channel coding can fit the overall bit-budget of coder specifications and deliver a robust performance under channel error conditions.

However, at low bit rates (4 kbps and below), time-domain coders such as the CELP coder fail to retain high quality and robust performance due to the limited number of available bits. At low bit rates, the limited codebook space clips the waveform-matching capability of conventional time-domain coders, which are so successfully deployed in higher-rate commercial applications.

One effective technique to encode speech efficiently at low bit rate is multimode coding. A multimode coder applies different modes, or encoding-decoding algorithms, to different types of input speech frames. Each mode, or encoding-decoding process, is customized to represent a certain type of speech segment (i.e., voiced, unvoiced, or background noise) in the most efficient manner. An external mode decision mechanism examines the input speech frame and make a decision regarding which mode to apply to the frame. Typically, the mode decision is done in an open-loop fashion by extracting a number of parameters out of the input frame and evaluating them to make a decision as to which mode to apply. Thus, the mode decision is made without knowing in advance the exact condition of the output speech, i.e., how similar the output speech will be to the input speech in terms of voice-quality or any other performance measure. An exemplary open-loop mode decision for a speech codec is described in U.S. Pat. No. 5,414,796, which is assigned to the assignee of the present invention and fully incorporated herein by reference.

Multimode coding can be fixed-rate, using the same number of bits $N_0$ for each frame, or variable-rate, in which different bit rates are used for different modes. The goal in variable-rate coding is to use only the amount of bits needed to encode the codec parameters to a level adequate to obtain the target quality. As a result, the same target voice quality as that of a fixed-rate, higher-rate coder can be obtained at a significant lower average-rate using variable-bit-rate (VBR) techniques. An exemplary variable rate speech coder is described in U.S. Pat. No. 5,414,796, assigned to the assignee of the present invention and previously fully incorporated herein by reference.

Voiced speech segments are termed quasi-periodic in that such segments can be broken into pitch prototypes, or small segments whose length L(n) vary with time as the pitch or fundamental frequency of periodicity varies with time. Such segments, or pitch prototypes, have a strong degree of correlation, i.e., they are extremely similar to each other. This is especially true of neighboring pitch prototypes. It is advantageous in designing an efficient multimode VBR coder that delivers high voice quality at low average rate to represent the quasi-periodic voiced speech segments with a low-rate mode.

It would be desirable to provide a speech model, or analysis-synthesis method, that represents quasi-periodic voiced segments of speech. It would further be advantageous to design a model that provides a high quality synthesis, thereby creating speech with high voice quality. It would still further be desirable for the model to have a small set of parameters so as to be amenable for encoding with a small set of bits. Thus, there is a need for a method of time-synchronous waveform interpolation for voiced speech segments that requires a minimal amount of bits for encoding and yields a high quality speech synthesis.

SUMMARY OF THE INVENTION

The present invention is directed to a method of time-synchronous waveform interpolation for voiced speech segments that requires a minimal amount of bits for encoding and yields a high quality speech synthesis. Accordingly, in one aspect of the invention, a method of synthesizing speech from pitch prototype waveforms by time-synchronous waveform interpolation advantageously includes the steps of extracting at least one pitch prototype per frame from a signal; applying a phase shift to the extracted pitch prototype relative to a previously extracted pitch prototype; upsampling the pitch prototype for each sample point within the frame; constructing a two-dimensional prototype-evolving surface; and re-sampling the two-dimensional surface to create a one-dimensional synthesized signal frame, the re-sampling points being defined by piecewise continuous cubic phase contour functions, the phase contour functions being computed from pitch lags and alignment phase shifts added to the extracted pitch prototype.

In another aspect of the invention, a device for synthesizing speech from pitch prototype waveforms by time-synchronous waveform interpolation advantageously includes means for extracting at least one pitch prototype per frame from a signal; means for applying a phase shift to the extracted pitch prototype relative to a previously extracted pitch prototype; means for upsampling the pitch prototype for each sample point within the frame; means for constructing a two-dimensional prototype-evolving surface; and means for re-sampling the two-dimensional surface to create a one-dimensional synthesized signal frame, the re-sampling points being defined by piecewise continuous cubic phase contour functions, the phase contour functions being computed from pitch lags and alignment phase shifts added to the extracted pitch prototype.

In another aspect of the invention, a device for synthesizing speech from pitch prototype waveforms by time-synchronous waveform interpolation advantageously includes a module configured to extract at least one pitch prototype per frame from a signal; a module configured to apply a phase shift to the extracted pitch prototype relative to a previously extracted pitch prototype; a module configured to upsample the pitch prototype for each sample point within the frame; a module configured to construct a two-dimensional prototype-evolving surface; and a module configured to re-sample the two-dimensional surface to create a one-dimensional synthesized signal frame, the re-sampling points being defined by piecewise continuous cubic phase contour functions, the phase contour functions being computed from pitch lags and alignment phase shifts added to the extracted pitch prototype.

DETAILED DESCRIPTION OF THE PREFERRED EMBODIMENTS

Figure 1:
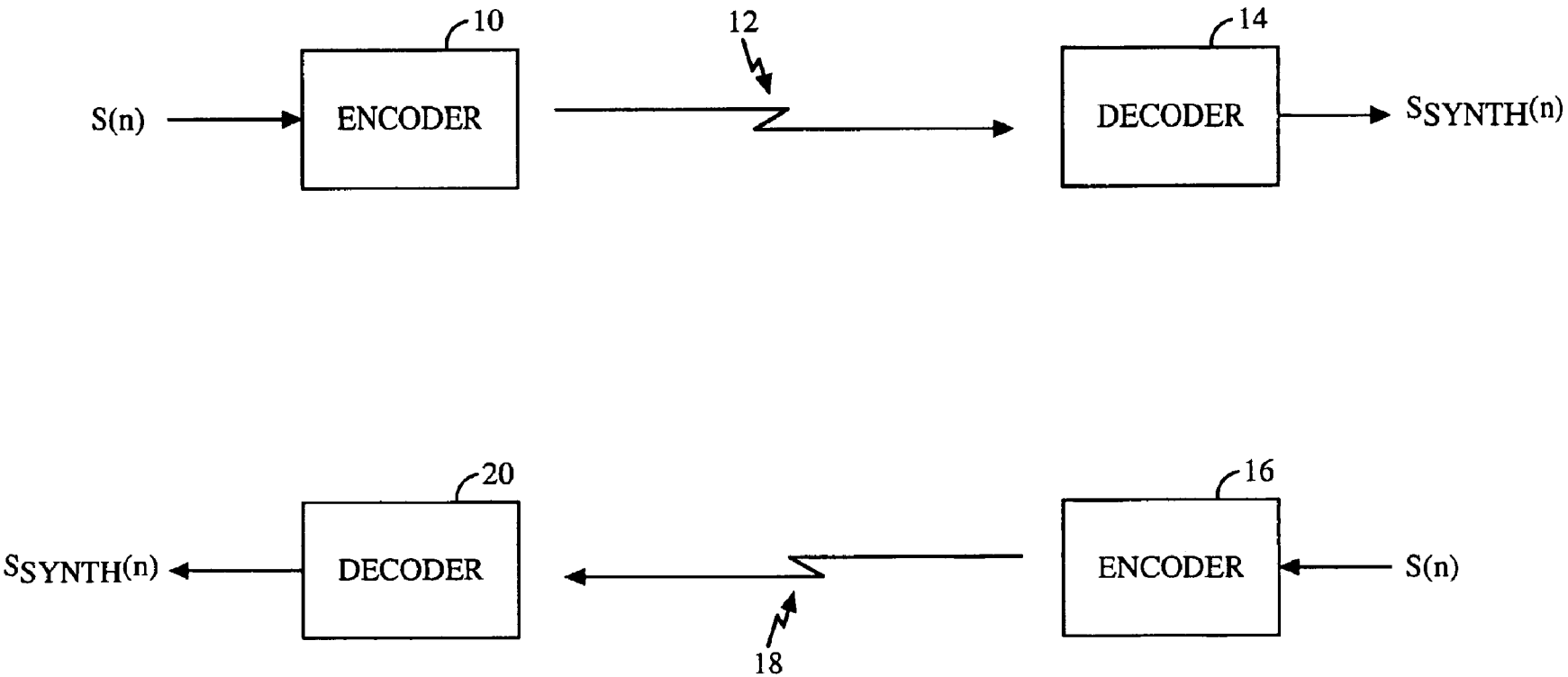
FIG. 1 is a block diagram of a communication channel terminated at each end by speech coders.

In FIG. 1 a first encoder 10 receives digitized speech samples s(n) and encodes the samples s(n) for transmission on a transmission medium 12, or communication channel 12, to a first decoder 14. The decoder 14 decodes the encoded speech samples and synthesizes an output speech signal $s_{SYNTH}(n)$. For transmission in the opposite direction, a second encoder 16 encodes digitized speech samples s(n), which are transmitted on a communication channel 18. A second decoder 20 receives and decodes the encoded speech samples, generating a synthesized output speech signal $s_{SYNTH}(n)$.

The speech samples s(n) represent speech signals that have been digitized and quantized in accordance with any of various methods known in the art including, e.g., pulse code modulation (PCM), companded $\mu$-law, or A-law. As known in the art, the speech samples s(n) are organized into frames of input data wherein each frame comprises a predetermined number of digitized speech samples s(n). In an exemplary embodiment, a sampling rate of 8 kHz is employed, with each 20 ms frame comprising 160 samples. In the embodiments described below, the rate of data transmission may advantageously be varied on a frame-to-frame basis from 8 kbps (full rate) to 4 kbps (half rate) to 2 kbps (quarter rate) to 1 kbps (eighth rate). Varying the data transmission rate is advantageous because lower bit rates may be selectively employed for frames containing relatively less speech information. As understood by those skilled in the art, other sampling rates, frame sizes, and data transmission rates may be used.

The first encoder 10 and the second decoder 20 together comprise a first speech coder, or speech codec. Similarly, the second encoder 16 and the first decoder 14 together comprise a second speech coder. It is understood by those of skill in the art that speech coders may be implemented with a digital signal processor (DSP), an application-specific integrated circuit (ASIC), discrete gate logic, firmware, or any conventional programmable software module and a microprocessor. The software module could reside in RAM memory, flash memory, registers, or any other form of writable storage medium known in the art. Alternatively, any conventional processor, controller, or state machine could be substituted for the microprocessor. Exemplary ASICs designed specifically for speech coding are described in U.S. Pat. No. 5,727,123, assigned to the assignee of the present invention and fully incorporated herein by reference, and U.S. application Ser. No. 08/197,417, entitled VOCODER ASIC, filed Feb. 16, 1994, assigned to the assignee of the present invention, and fully incorporated herein by reference.

Figure 2:
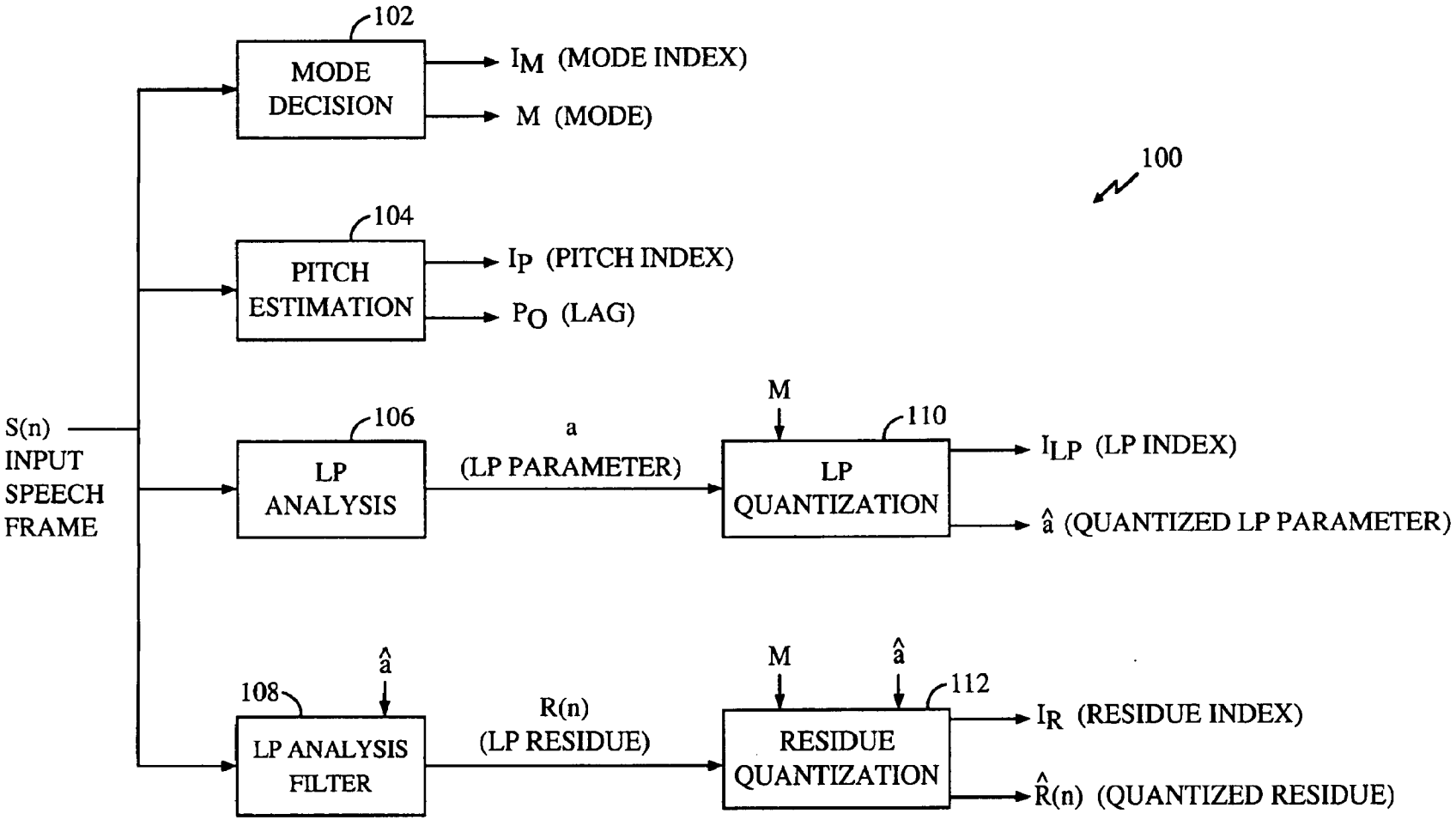
FIG. 2 is a block diagram of an encoder.

In FIG. 2 an encoder 100 that may be used in a speech coder includes a mode decision module 102, a pitch estimation module 104, an LP analysis module 106, an LP analysis filter 108, an LP quantization module 110, and a residue quantization module 112. Input speech frames s(n) are provided to the mode decision module 102, the pitch estimation module 104, the LP analysis module 106, and the LP analysis filter 108. The mode decision module 102 produces a mode index $I_M$ and a mode M based upon the periodicity of each input speech frame s(n). Various methods of classifying speech frames according to periodicity are described in U.S. application Ser. No. 08/815,354, entitled METHOD AND APPARATUS FOR PERFORMING REDUCED RATE VARIABLE RATE VOCODING, filed Mar. 11, 1997, assigned to the assignee of the present invention, and fully incorporated herein by reference. Such methods are also incorporated into the Telecommunication Industry Association Industry Interim Standards TIA/EIA IS-127 and TIA/EIA IS-733.

The pitch estimation module 104 produces a pitch index $I_P$ and a lag value $P_0$ based upon each input speech frame s(n). The LP analysis module 106 performs linear predictive analysis on each input speech frame s(n) to generate an LP parameter a. The LP parameter a is provided to the LP quantization module 110. The LP quantization module 110 also receives the mode M. The LP quantization module 110 produces an LP index $I_{LP}$ and a quantized LP parameter â. The LP analysis filter 108 receives the quantized LP parameter â in addition to the input speech frame s(n). The LP analysis filter 108 generates an LP residue signal R[n], which represents the error between the input speech frames s(n) and the quantized linear predicted parameters â. The LP residue R[n], the mode M, and the quantized LP parameter â are provided to the residue quantization module 112. Based upon these values, the residue quantization module 112 produces a residue index $I_R$ and a quantized residue signal $\hat{R}[n]$.

Figure 3:
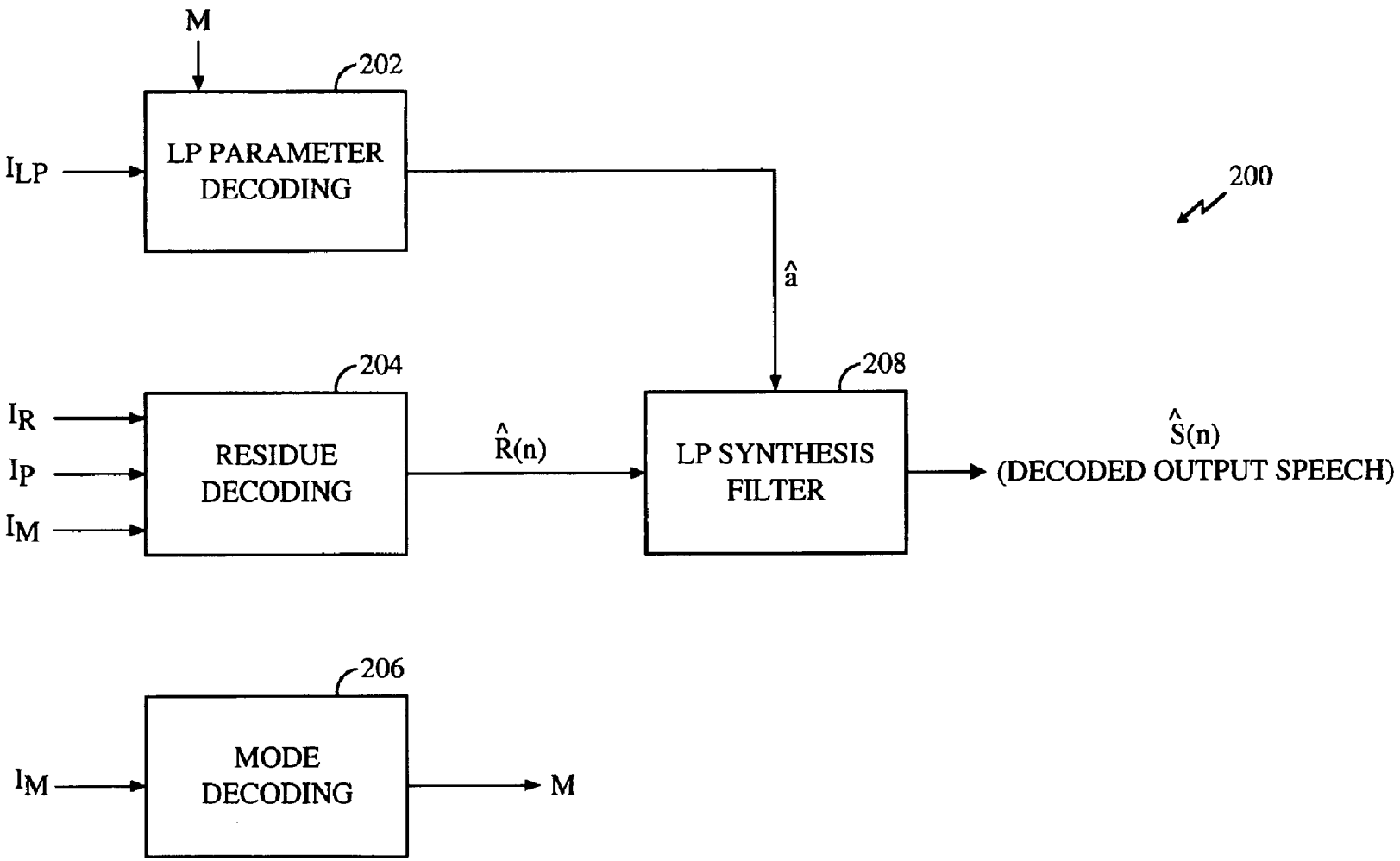
FIG. 3 is a block diagram of a decoder.

In FIG. 3 a decoder 200 that may be used in a speech coder includes an LP parameter decoding module 202, a residue decoding module 204, a mode decoding module 206, and an LP synthesis filter 208. The mode decoding module 206 receives and decodes a mode index $I_M$, generating therefrom a mode M. The LP parameter decoding module 202 receives the mode M and an LP index $I_{LP}$. The LP parameter decoding module 202 decodes the received values to produce a quantized LP parameter â. The residue decoding module 204 receives a residue index $I_R$, a pitch index $I_P$, and the mode index $I_M$. The residue decoding module 204 decodes the received values to generate a quantized residue signal $\hat{R}[n]$. The quantized residue signal $\hat{R}[n]$ and the quantized LP parameter â are provided to the LP synthesis filter 208, which synthesizes a decoded output speech signal $\hat{s}[n]$ therefrom.

Operation and implementation of the various modules of the encoder 100 of FIG. 2 and the decoder of FIG. 3 are known in the art. An exemplary encoder and an exemplary decoder are described in U.S. Pat. No. 5,414,796, previously fully incorporated herein by reference.

In one embodiment quasi-periodic, voiced segments of speech are modeled by extracting pitch prototype waveforms from the current speech frame $S_{cur}$ and synthesizing the current speech frame from the pitch prototype waveforms by time-synchronous waveform interpolation (TSWI). By extracting and retaining only a number M of pitch prototype waveforms $W_m$, for m=1,2, . . . ,M, each pitch prototype waveform $W_m$ having a length $L_{cur}$, where $L_{cur}$ is the current pitch period from the current speech frame $S_{cur}$, the amount of information that must be encoded is reduced from N samples to the product of M and $L_{cur}$ samples. The number M may either be given a value of 1, or be given any discrete value based on the pitch lag. A higher value of M is often required for a small value of $L_{cur}$ to prevent the reconstructed voiced signal from being overly periodic. In an exemplary embodiment, if the pitch lag is greater than 60, M is set equal to 1. Otherwise, M is set equal to 2. The M current prototypes and the final pitch prototype $W_o$, which has a length $L_0$, from the previous frame, are used to recreate a model representation $S_{cur_model}$ of the current speech frame by employing an TSWI technique described in detail below. It should be noted that as an alternative to choosing current prototypes $W_m$ having the same length $L_{cur}$, the current prototypes $W_m$ may instead have lengths $L_m$, where the local pitch period $L_m$ can be estimated by either estimating the true pitch period at the pertinent discrete time location $n_m$, or by applying any conventional interpolation technique between the current pitch period $L_{cur}$ and the last pitch period $L_0$. The interpolation technique used may be, e.g., simple linear interpolation:

$$L_m=(1-n_m/N)*L_0+(n_m/N)*L_{cur},$$

where the time index $n_m$ is the mid-point of the m-th segment, where m=1,2, . . . ,M.

Figure 4:
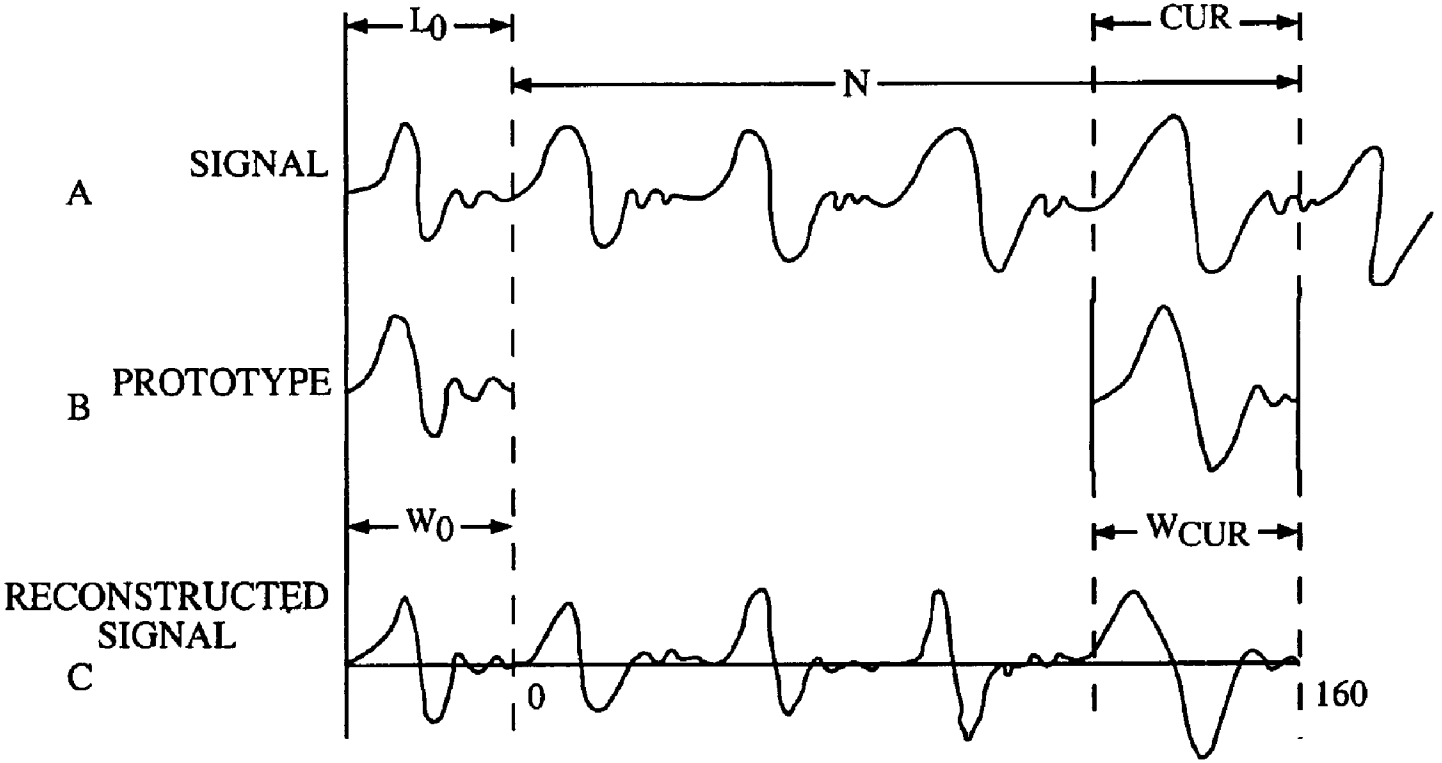
FIGS. 4A–C are graphs of signal amplitude versus discrete time index, extracted prototype amplitude versus discrete time index, and TSWI-reconstructed signal amplitude versus discrete time index, respectively.

The above relationships are illustrated in the graphs of FIGS. 4A–C. In FIG. 4A, which depicts signal amplitude versus discrete time index (i.e., sample number), a frame length N represents the number of samples per frame. In the embodiment shown N is 160. The values $L_{cur}$ (the current pitch period in the frame) and $L_0$ (the final pitch period in the preceding frame) are also shown. It should be pointed out that that signal amplitude may be either speech signal amplitude or residual signal amplitude, as desired. In FIG. 4B, which depicts prototype amplitude versus discrete time index for the case M=1, the values $W_{cur}$ (the current prototype) and $W_0$ (the final prototype of the previous frame) are illustrated. The graph of FIG. 4C illustrates the amplitude of the reconstructed signal $S_{cur_model}$ after TSWI synthesis versus discrete time index.

The mid-points $n_m$ in the above interpolation equation are advantageously chosen so that the distances between adjacent mid-points are nearly the same. For example, M=3, N=160, $L_0$=40, and $L_{cur}$=42, yields $n_0$=−20 and $n_3$=139, so $n_1$=33 and $n_2$=86, the distance between neighboring segments being [139−(−20)/3], or 53.

The last prototype of the current frame $W_M$ is extracted by picking the last $L_{cur}$ samples of the current frame. Other middle prototypes $W_m$ are extracted by picking $(L_m)/2$ samples around the mid-points $n_m$.

The prototype extraction may be further refined by allowing a dynamic shift of $D_m$ for each prototype $W_m$ so that any $L_m$ samples out of the range $\{n_m-0.5*L_m-D_m, n_m+0.5*L_m+D_m\}$ can be picked to constitute the prototype. It is desirable to avoid high energy segments at the prototype boundary. The value $D_m$ can be variable over m or it can be fixed for each prototype.

It should be pointed out that a nonzero dynamic shift $D_m$ would necessarily destroy the time-synchrony between the extracted prototypes $W_m$ and the original signal. One simple solution to this problem is to apply a circular shift to the prototype $W_m$ to adjust the offset that the dynamic shift has introduced. For example, when the dynamic shift is set to zero, the prototype extraction begins at time index n=100. On the other hand, when $D_m$ is applied, the prototype extraction begins at n=98. In order to maintain the time-synchrony between the prototype and the original signal, the prototype can be shifted circularly to the right by 2 samples (i.e., 100–98 samples) after the prototype is extracted.

To avoid mismatches at the frame boundaries, it is important to maintain time synchrony of the synthesized speech. It is desirable, therefore, that the speech synthesized with the analysis-synthesis process should be well-aligned with the input speech. In one embodiment the above goal is achieved by explicitly controlling the boundary values of the phase track, as described below. Time synchrony is also particularly crucial for a linear-predictive-based multimode speech coder, in which one mode might be CELP and another mode might be prototype-based analysis-synthesis. For a frame being coded with CELP, if the prior frame is coded with a prototype-based method in the absence of time-alignment or time-synchrony, the analysis-by-synthesis waveform-matching power of CELP cannot be harnessed. Any break in time synchrony in the past waveform will not allow CELP to depend on memory for the prediction because the memory will be misaligned with the original speech due to lack of time-synchrony.

Figure 5:
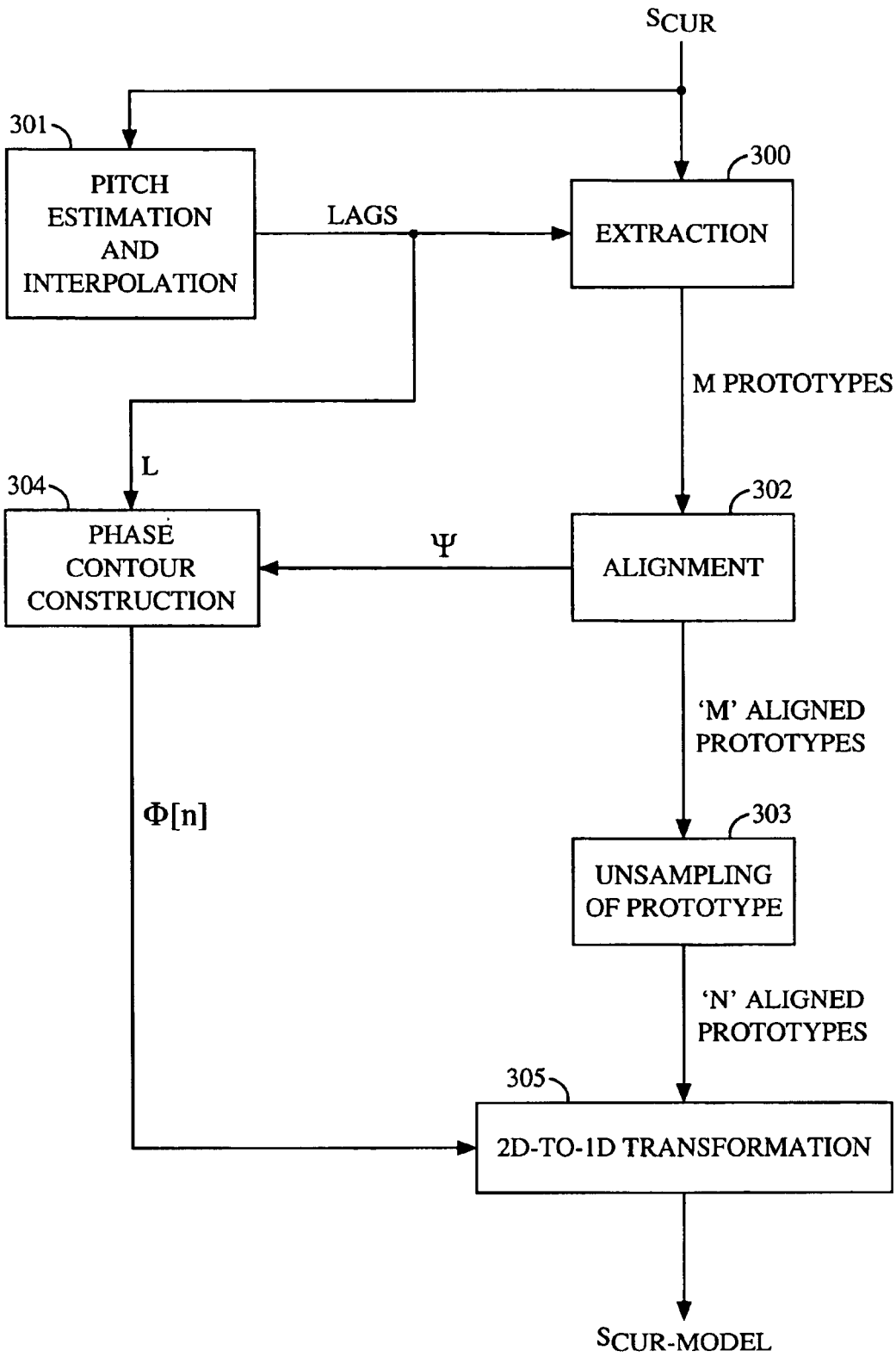
FIG. 5 is a functional block diagram illustrating a device for synthesizing speech from pitch prototype waveforms by time-synchronous waveform interpolation (TSWI).

The block diagram of FIG. 5 illustrates a device for speech synthesis with TSWI in accordance with one embodiment. Starting with a frame of size N, M prototypes $W_1, W_2, \ldots W_M$ of length $L_1, L_2, \ldots, L_M$ are extracted in block 300. In the extraction process, a dynamic shift is used on each extraction to avoid high energy at the prototype boundary. Next, an appropriate circular shift is applied to each extracted prototype so as to maximize the time-synchrony between the extracted prototypes and the corresponding segment of the original signal. The $m^{th}$ prototype $W_m$ has $L_m$ samples indexed by k sample number, i.e., k=1,2, . . . ,$L_m$. This index k can be normalized and remapped to a new phase index $\phi$ which ranges from 0 to $2\pi$. In block 301 pitch estimation and interpolation are employed to generate pitch lags.

The end point locations of the prototypes are labeled as $n_1, n_2, \ldots, n_M$ where $0<n_1<n_2<\ldots<n_M=N$. The prototypes can now be represented according to their end point locations as follows:

$$X(n_1,\phi)=W_1$$

$$X(n_2,\phi)=W_2$$

$$X(n_M,\phi)=W_M$$

It should be noted that $X(n_0, \phi)$ represents the final extracted prototype in the previous frame and $X(n_0, \phi)$ has a length of $L_0$. It should also be pointed out that $\{n_1, n_2, \ldots, n_M\}$ may or may not be equally spaced over the current frame.

In block 302, where the alignment process is performed, a phase shift $\psi$ is applied to each prototype X so that the successive prototypes are maximally aligned. Specifically, $$W(n_1,\phi)=X(n_1,\phi+\psi_1)$$

$$W(n_2,\phi)=X(n_2,\phi+\psi_2)$$

$$W(n_M,\phi)=X(n_M,\phi+\psi_M)$$

where W represents the aligned version of X and the alignment shift $\psi$ can be calculated by:

$$\psi_i = \underset{0 \le \psi' \le 2\pi}{\operatorname{argmax}} Z[X(n_i, \phi+\psi'),\ W(n_{i-1}, \phi)], \quad i = 1, 2, \ldots, M.$$

Z[X, W] represents the cross-correlation between X and W.

The M prototypes are upsampled to N prototypes in block 303 by any conventional interpolation technique. The interpolation technique used may be, e.g., simple linear interpolation:

$$W(n, \phi) = \frac{(n_i - n) * W(n_{i-1}, \phi) + (n - n_{i-1}) * W(n_i, \phi)}{n_i - n_{i-1}};$$

$$n_{i-1} < n \le n_i$$

$$i = 1, 2, \ldots, M$$

Figure 6:
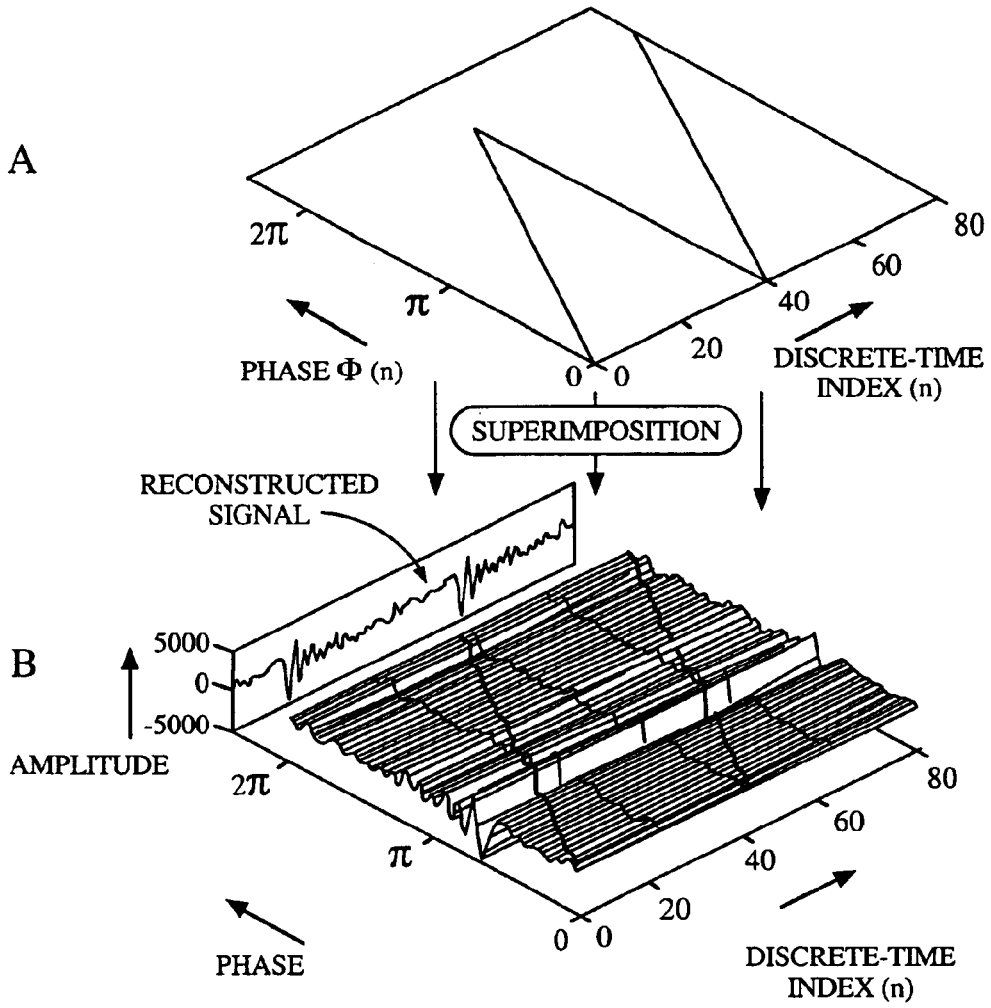
FIG. 6A is a graph of wrapped cubic phase contour versus discrete time index.
FIG. 6B is a two-dimensional surface graph of reconstructed speech signal amplitude versus the superimposed graph of FIG. 6A.

The set of N prototypes, $W(n_i,\phi)$, where i=1,2, . . . ,N, forms a two-dimensional (2-D) prototype-evolving surface, as shown in FIG. 6B.

Block 304 performs the computation of the phase track. In waveform interpolation, a phase track $\Phi[N]$ is used to transform the 2-D prototype-evolving surface back to a 1-D signal. Conventionally, such a phase contour is computed on a sample-by-sample basis using interpolated frequency values as follows:

$$\Phi[n] = \Phi[n-1] + 2\pi \int_{n-1}^{n} F[n'] * dn'$$

where n=1,2, . . . ,N. The frequency contour F[n] can be computed using the interpolated pitch track, specifically, F[n]=1/L[n], where L[n] represents the interpolated version of $\{L_1, L_2, \ldots, L_M\}$. The above phase contour function is typically derived once per frame with the initial phase value $\Phi_0=\Phi[0]$, and not with the final value $\Phi_N=\Phi[N]$. Further, the phase contour function takes no account of the phase shift $\psi$ resulting from the alignment process. For this reason, the reconstructed waveform is not guaranteed to be time-synchronous to the original signal. It should be noted that if the frequency contour is assumed to evolve linearly over time, the resulting phase track $\Phi[n]$ is a quadratic function of time index (n).

In the embodiment of FIG. 5, the phase contour is advantageously constructed in a piecewise fashion where the initial and the final boundary phase values are closely matched with the alignment shift values. Suppose time synchrony is desired to be preserved at p time instants in the current frame, $n_{\alpha 1}, n_{\alpha 2}, \ldots, n_{\alpha_p}$ where $n_{\alpha 1}<n_{\alpha 2}<, \ldots, <n_{\alpha_p}$ and $\alpha_1 \in\{1, 2, \ldots, M\}$, i=1, 2, . . . ,p. The resulting $\Phi[n]$, n=1,2, . . . , N, is composed of p piecewise continuous phase functions that can be written as follows:

$$\Phi[n]=\begin{cases} \Phi_{\alpha_1}[n]=a_{\alpha_1}(n-n_{\alpha_0})^3+b_{\alpha_1}(n-n_{\alpha_0})^2+c_{\alpha_1}(n-n_{\alpha_0})+d_{\alpha_1} & n_0<n\le n_{\alpha_1} \\ \Phi_{\alpha_2}[n]=a_{\alpha_2}(n-n_{\alpha_1})^3+b_{\alpha_2}(n-n_{\alpha_1})^2+c_{\alpha_2}(n-n_{\alpha_1})+d_{\alpha_2} & n_{\alpha_1}<n\le n_{\alpha_2} \\ \vdots & \vdots \\ \Phi_{\alpha_p}[n]=a_{\alpha_p}(n-n_{\alpha_{p-1}})^3+b_{\alpha_p}(n-n_{\alpha_{p-1}})^2+c_{\alpha_p}(n-n_{\alpha_{p-1}})+d_{\alpha_p} & n_{\alpha_{p-1}}<n\le n_{\alpha_p} \end{cases}$$

It should be pointed out that $n_{\alpha_p}$ is typically set to $n_M$ so that $\Phi[n]$ can be computed for the entire frame, i.e., for n=1,2, . . . , N. The coefficients {a, b, c, d} of each piecewise phase function can be computed by four boundary conditions: the initial and the final pitch lags, $L_{\alpha_{i-1}}$ and $L_{\alpha_1}$ respectively, and the initial and the final alignment shifts, $\psi_{\alpha_{i-1}}$ and $\psi_{\alpha_1}$. Specifically, the coefficients can be solved by:

$$\begin{bmatrix} a_{\alpha_i} \\ b_{\alpha_i} \end{bmatrix}=\begin{bmatrix} 3T_i^2 & 2T_i \\ T_i^3 & T_i^2 \end{bmatrix}^{-1}\begin{bmatrix} 2\pi*\left(\frac{1}{L_{\alpha_i}}-\frac{1}{L_{\alpha_{i-1}}}\right) \\ \psi_{\alpha_i}-\psi_{\alpha_{i-1}}-\frac{2\pi*T_i}{L_{\alpha_{i-1}}}+2\pi\xi_{\alpha_i} \end{bmatrix}$$

$$c_{\alpha_i}=\frac{2\pi}{L_{\alpha_{i-1}}}$$

$$d_{\alpha_i}=\psi_{\alpha_{i-1}}$$

and $$T_1=n_{\alpha_1}-n_{\alpha_{i-1}}$$

where i=1, 2, . . . , p. Because the alignment shift $\psi$ is obtained modulo $2\pi$, the factor $\xi$ is used to unwrap the phase shifts such that the resulting phase function is maximally smooth. The value $\xi$ can be computed as follows:

$$\xi_{\alpha_i}=\text{round}\left[\frac{\psi_{\alpha_{i-1}}-\psi_{\alpha_i}}{2\pi}+\frac{T_i}{2}*\left(\frac{1}{L_{\alpha_i}}+\frac{1}{L_{\alpha_{i-1}}}\right)\right]$$

where i=1, 2, . . . , p and the function round[x] finds the nearest integer to x. For example, round[1.4] is 1.

Figure 7:
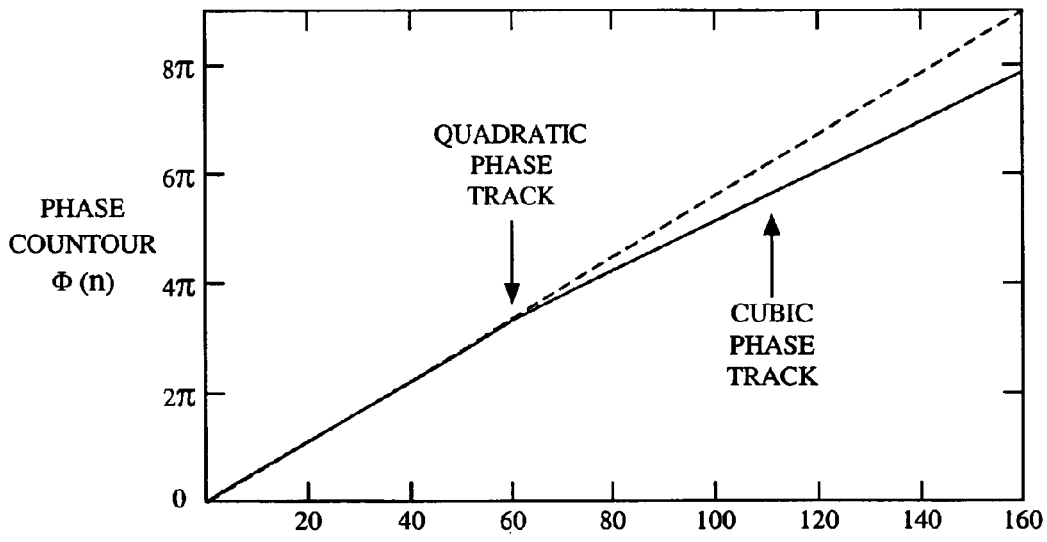
FIG. 7 is a graph of unwrapped quadratic and cubic phase contours versus discrete time index.

An exemplary unwrapped phase track is illustrated in FIG. 7 for the case M=p=1 and $L_o$=40, $L_M$=46. Following the cubic phase contour (as opposed to adhering to the conventional, quadratic phase contour shown with a dashed line) guarantees time synchrony of the synthesized waveform $S_{cur_model}$ with the original frame of speech $S_{cur}$ at the frame boundary.

In block 305 a one-dimensional (1-D) time-domain waveform is formed from the 2-D surface. The synthesized waveform $S_{cur_model}[n]$, where n=1, 2, . . . , N, is formed by:

$$S_{cur_model}[n]=W(n,\Phi[n])$$

Graphically, the above transformation is equivalent to superimposing the wrapped phase track depicted in FIG. 6A on the 2-D surface, as shown in FIG. 6B. The projection of the intersection (where the phase track meets the 2-D surface) onto the plane perpendicular to the phase axis is $S_{cur_model}[n]$.

In one embodiment the process of prototype extraction and TSWI based analysis-synthesis is applied to the speech domain. In an alternate embodiment the process of prototype extraction and TSWI based analysis-synthesis is applied to the LP residue domain as well as the speech domain described here for.

In one embodiment a pitch-prototype-based, analysis-synthesis model is applied after a pre-selection process in which it is determined whether the current frame is "periodic enough." The periodicity $PF_m$ between neighboring extracted prototypes, $W_m$ and $W_{m+1}$, can be computed as:

$$PF_m=\frac{\sum_{n=1}^{L_{\max}} W_m[n]*W_{m+1}[n]}{\sqrt{\sum_{n=1}^{L_{\max}} W_m[n]*W_m[n]}\sqrt{\sum_{n=1}^{L_{\max}} W_{m+1}[n]*W_{m+1}[n]}}$$

where $L_{max}$ is the maximum of $[L_m, L_{m+1}]$, the maximum of the lengths of the prototypes $W_m$ and $W_{m+1}$.

The M sets of periodicities $PF_m$ can be compared with a set of thresholds to determine whether the prototypes of the current frame are extremely similar, or whether the current frame is highly periodic. The mean value of the set of periodicities $PF_m$ may advantageously be compared with a predetermined threshold to arrive at the above decision. If the current frame is not periodic enough, then a different higher-rate algorithm (i.e., one that is not pitch-prototype based) may be used instead to encode the current frame.

In one embodiment a post-selection filter may be applied to evaluate performance. Thus, after encoding the current frame with a pitch-prototype-based, analysis-synthesis mode, a decision is made regarding whether the performance is good enough. The decision is made by obtaining a quality measure such as, e.g., PSNR, where PSNR is defined as follows:

$$PSNR=10*\log10\frac{\sum_{n=1}^{N}(x[n]-e[n])^2}{\sum_{n=1}^{N}e[n]*e[n]}$$

where x[n]=h[n]*R[n], and e(n)=h[n]*qR[n], with "*" denoting a convolution or filtering operation, h(n) being a perceptually weighted LP filter, R[n] being the original speech residue, and qR[n] being the residue obtained by the pitch-prototype-based, analysis-synthesis mode. The above equation for PSNR is valid if pitch-prototype-based, analysis-synthesis encoding is applied to the LP residue signal. If, on the other hand, the pitch-prototype-based, analysis-synthesis technique is applied to the original speech frame instead of the LP residue, the PSNR may be defined as:

$$PSNR = 10 * \log10 \frac{\sum_{n=1}^{N} w[n] * (x[n] - e[n])^2}{\sum_{n=1}^{N} w[n] * e[n] * e[n]}$$

where x[n] is the original speech frame, e[n] is the speech signal modeled by the pitch-prototype-based, analysis-synthesis technique, and w[n] are perceptual weighting factors. If, in either case, the PSNR is below a predetermined threshold, the frame is not suitable for an analysis-synthesis technique, and a different, possibly higher-bit-rate algorithm may be used instead to capture the current frame. Those skilled in the art would understand that any conventional performance measure, including the exemplary PSNR measure described above, may be used instead for the post-processing decision as to algorithm performance.

Preferred embodiments of the present invention have thus been shown and described. It would be apparent to one of ordinary skill in the art, however, that numerous alterations may be made to the embodiments herein disclosed without departing from the spirit or scope of the invention. Therefore, the present invention is not to be limited except in accordance with the following claims.

What is claimed is:

1. A method of synthesizing speech from pitch prototype waveforms by time-synchronous waveform interpolation, comprising the steps of:

extracting at least one pitch prototype per frame from a signal;

applying a phase shift to the extracted pitch prototype relative to a previously extracted pitch prototype;

upsampling the pitch prototype for each sample point within the frame;

constructing a two-dimensional prototype-evolving surface; and re-sampling the two-dimensional surface to create a one-dimensional synthesized signal frame, the re-sampling points being defined by piecewise continuous cubic phase contour functions, the phase contour functions being computed from pitch lags and alignment phase shifts added to the extracted pitch prototype.

2. The method of claim 1, wherein the signal comprises a speech signal.

3. The method of claim 1, wherein the signal comprises a residue signal.

4. The method of claim 1, wherein the final pitch prototype waveform comprises lag samples of the previous frame.

5. The method of claim 1, further comprising the step of calculating the periodicity of a current frame to determine whether to perform the remaining steps.

6. The method of claim 1, further comprising the steps of obtaining a post-processing performance measure and comparing the post-processing performance measure with a predetermined threshold.

7. The method of claim 1, wherein the extracting step comprises extracting only one pitch prototype.

8. The method of claim 1, wherein the extracting step comprises extracting a number of pitch prototypes, the number being a function of pitch lag.

9. A device for synthesizing speech from pitch prototype waveforms by time-synchronous waveform interpolation, comprising:

means for extracting at least one pitch prototype per frame from a signal;

means for applying a phase shift to the extracted pitch prototype relative to a previously extracted pitch prototype;

means for upsampling the pitch prototype for each sample point within the frame;

means for constructing a two-dimensional prototype-evolving surface; and means for re-sampling the two-dimensional surface to create a one-dimensional synthesized signal frame, the re-sampling points being defined by piecewise continuous cubic phase contour functions, the phase contour functions being computed from pitch lags and alignment phase shifts added to the extracted pitch prototype.

10. The device of claim 9, wherein the signal comprises a speech signal.

11. The device of claim 9, wherein the signal comprises a residue signal.

12. The device of claim 9, wherein the final pitch prototype waveform comprises lag samples of the previous frame.

13. The device of claim 9, further comprising means for calculating the periodicity of a current frame.

14. The device of claim 9, further comprising means for obtaining a post-processing performance measure and means for comparing the post-processing performance measure with a predetermined threshold.

15. The device of claim 9, wherein the means for extracting comprises means for extracting only one pitch prototype.

16. The device of claim 9, wherein the means for extracting comprises means for extracting a number of pitch prototypes, the number being a function of pitch lag.

17. A device for synthesizing speech from pitch prototype waveforms by time-synchronous waveform interpolation, comprising:

a module configured to extract at least one pitch prototype per frame from a signal;

a module configured to apply a phase shift to the extracted pitch prototype relative to a previously extracted pitch prototype;

a module configured to upsample the pitch prototype for each sample point within the frame;

a module configured to construct a two-dimensional prototype-evolving surface; and a module configured to re-sample the two-dimensional surface to create a one-dimensional synthesized signal frame, the re-sampling points being defined by piecewise continuous cubic phase contour functions, the phase contour functions being computed from pitch lags and alignment phase shifts added to the extracted pitch prototype.

18. The device of claim 17, wherein the signal comprises a speech signal.

19. The device of claim 17, wherein the signal comprises a residue signal.

20. The device of claim 17, wherein the final pitch prototype waveform comprises lag samples of the previous frame.

21. The device of claim 17, further comprising a module configured to calculate the periodicity of a current frame.

22. The device of claim 17, further comprising a module configured to obtain a post-processing performance measure and compare the post-processing performance measure with a predetermined threshold.

23. The device of claim 17, wherein the module configured to extract at least one pitch prototype comprises a module configured to extract only one pitch prototype.

24. The device of claim 17, wherein the module configured to extract at least one prototype comprises a module configured to extract a number of pitch prototypes, the number being a function of pitch lag.

25. A device for synthesizing speech from pitch prototype waveforms by time-synchronous waveform interpolation, comprising:

a processor; and a storage medium coupled to the processor and containing a set of instructions executable by the processor to:

extract at least one pitch prototype per frame from a signal, apply a phase shift to the extracted pitch prototype relative to a previously extracted pitch prototype, upsample the pitch prototype for each sample point within the frame, construct a two-dimensional prototype-evolving surface, and re-sample the two-dimensional surface to create one-dimensional synthesized signal frame, the re-sampling points being defined by piecewise continuous cubic phase contour functions, the phase contour functions being computed from pitch lags and alignment phase shifts added to the extracted pitch prototype.

26. The device of claim 25, wherein the signal comprises a speech signal.

27. The device of claim 25, wherein the signal comprises a residue signal.

28. The device of claim 25, wherein the final pitch prototype waveform comprises lag samples of the previous frame.

29. The device of claim 25, wherein the set of instructions is further executable by the processor to calculate the periodicity of a current frame.

30. The device of claim 25, wherein the set of instructions is further executable by the processor to obtain a post-processing performance measure and compare the post-processing performance measure with a predetermined threshold.

31. The device of claim 25, wherein the set of instructions is further executable by the processor to extract only one pitch prototype.

32. The device of claim 25, wherein the set of instructions is further executable by the processor to extract a number of pitch prototypes, the number being a function of pitch lag.

33. A method of synthesizing speech from pitch prototype waveforms by time-synchronous waveform interpolation, comprising the steps of:

extracting at least one pitch prototype per frame from a signal;

applying a first phase shift to the extracted pitch prototype relative to the signal;

applying a second phase shift to the extracted pitch prototype relative to a previously extracted pitch prototype;

upsampling the pitch prototype for each sample point within the frame;

constructing a two-dimensional prototype-evolving surface; and re-sampling the two-dimensional surface to create a one-dimensional synthesized signal frame, the re-sampling points being defined by piecewise continuous cubic phase contour functions, the phase contour functions being computed from pitch lags and alignment phase shifts added to the extracted pitch prototype.

34. The method of claim 33, wherein the signal comprises a speech signal.

35. The method of claim 33, wherein the signal comprises a residue signal.

36. The method of claim 33, wherein the final pitch prototype waveform comprises lag samples of the previous frame.

37. The method of claim 33, further comprising calculating the periodicity of a current frame to determine whether to perform the remaining steps.

38. The method of claim 33, further comprising obtaining a post-processing performance measure and comparing the post-processing performance measure with a predetermined threshold.

39. The method of claim 33, wherein the extracting comprises extracting only one pitch prototype.

40. The method of claim 33, wherein the extracting comprises extracting a number of pitch prototypes, the number being a function of pitch lag.

41. A device for synthesizing speech from pitch prototype waveforms by time-synchronous waveform interpolation, comprising:

means for extracting at least one pitch prototype per frame from a signal;

means for applying a first phase shift to the extracted pitch prototype relative to the signal;

means for applying a second phase shift to the extracted pitch prototype relative to a previously extracted pitch prototype:

means for upsampling the pitch prototype for each sample point within the frame;

means for constructing a two-dimensional prototype-evolving surface; and means for re-sampling the two-dimensional surface to create a one-dimensional synthesized signal frame, the re-sampling points being defined by piecewise continuous cubic phase contour functions, the phase contour functions being computed from pitch lags and alignment phase shifts added to the extracted pitch prototype.

42. The device of claim 41, wherein the signal comprises a speech signal.

43. The device of claim 41, wherein the signal comprises a residue signal.

44. The device of claim 41, wherein the final pitch prototype waveform comprises lag samples of the previous frame.

45. The device of claim 41, further comprising means for calculating the periodicity of a current frame.

46. The device of claim 41, further comprising means for obtaining a post-processing performance measure and means for comparing the post-processing performance measure with a predetermined threshold.

47. The device of claim 41, wherein the means for extracting comprises means for extracting only one pitch prototype.

48. The device of claim 41, wherein the means for extracting comprises means for extracting a number of pitch prototypes, the number being a function of pitch lag.

49. A device for synthesizing speech from pitch prototype waveforms by rime-synchronous waveform interpolation, comprising:

a module configured to extract at least one pitch prototype per frame from a signal;

a module configured to apply a first phase shift to the extracted pitch prototype relative to the signal;

a module configured to apply a second phase shift to the extracted pitch prototype relative to a previously extracted pitch prototype;

a module configured to upsample the pitch prototype for each sample a point within the frame;

a module configured to construct a two-dimensional prototype-evolving surface; and a module configured to re-sample the two-dimensional surface to create a one-dimensional synthesized signal frame, the re-sampling points being defined by piecewise continuous cubic phase contour functions, the phase contour functions being computed from pitch lags and alignment phase shifts added to the extracted pitch prototype.

50. The device of claim 49, wherein the signal comprises a speech signal.

51. The device of claim 49, wherein the signal comprises a idea signal.

52. The device of claim 49, wherein the final pitch prototype waveform comprises lag samples of the previous frame.

53. The device of claim 49, farther comprising a module configured to calculate the periodicity of a current frame.

54. The device of claim 49, further comprising a module configured to obtain a post-processing performance measure and compare the post-processing performance measure with a predetermined threshold.

55. The device of claim 49, wherein the module configured to extract at least one pitch prototype comprises a module configured to extract only one pitch prototype.

56. The device of claim 49, wherein the module configured to extract at least one prototype comprises a module configured to extract a number of pitch prototypes, the number being a function of pitch lag.

57. A device for synthesizing speech from pitch prototype waveforms by time-synchronous waveform interpolation, comprising:

a processor; and a storage medium coupled to the processor and containing a set of instructions executable by the processor to:

extract at least one pitch prototype per frame from a signal, apply a first phase shift to the extracted pitch prototype relative to the signal, apply a second phase shift to the extracted pitch prototype relative to a previously extracted pitch prototype, upsample the pitch prototype for each sample point within the frame, construct a two-dimensional prototype-evolving surface, and re-sample the two-dimensional surface to create one-dimensional synthesized signal frame, the re-sampling points being defined by piecewise continuous cubic phase contour functions, the phase contour functions being computed from pitch lags and alignment phase shifts added to the extracted pitch prototype.

58. The device of claim 57, wherein the signal comprises a speech signal.

59. The device of claim 57, wherein the signal comprises a residue signal.

60. The device of claim 57, wherein the final pitch prototype waveform comprises Lag samples of the previous frame.

61. The device of claim 57, wherein the set of instructions is further executable by the processor to calculate the periodicity of a current frame.

62. The device of claim 57, wherein the set of instructions is further executable by the processor to obtain a post-processing performance measure and compare the post-processing performance measure with a predetermined threshold.

63. The device of claim 57, wherein the set of instructions is further executable by the processor to extract only one pitch prototype.

64. The device of claim 57, wherein the set of instructions is further executable by the processor to extract a number of pitch prototypes, the number being a function of pitch lag.

* * * * *